US005197436A

United States Patent [19]

Ozawa

[11] Patent Number: 5,197,436

[45] Date of Patent: Mar. 30, 1993

[54] FUEL DELIVERY SYSTEM FOR V-TYPE ENGINE

[75] Inventor: Toshikazu Ozawa, Iwata, Japan

[73] Assignee: Yamaha Hatsudoki Kabushiki Kaisha, Iwata, Japan

[21] Appl. No.: 812,871

[22] Filed: Dec. 20, 1991

Related U.S. Application Data

[63] Continuation of Ser. No. 500,364, Mar. 28, 1990, abandoned.

[30] Foreign Application Priority Data

Mar. 31, 1989 [JP] Japan ..... 1-83664

[51] Int. Cl.[5] ..... F02M 55/02

[52] U.S. Cl. ..... 123/456; 123/472; 123/468

[58] Field of Search ..... 123/456, 468, 469, 470, 123/514, 472

[56] References Cited

U.S. PATENT DOCUMENTS

| | | | |
|---|---|---|---|
| 4,142,497 | 3/1979 | Long | 123/456 |
| 4,519,368 | 5/1985 | Hudson, Jr. | 123/468 |
| 4,586,477 | 5/1986 | Field et al. | 123/468 |
| 4,601,275 | 7/1986 | Weinand | 123/516 |
| 4,971,014 | 11/1990 | Usui | 123/468 |
| 5,056,489 | 10/1991 | Lorraine | 123/468 |

FOREIGN PATENT DOCUMENTS

| | | | |
|---|---|---|---|
| 1142824 | 3/1983 | Canada | 123/456 |

*Primary Examiner*—E. Rollins Cross
*Assistant Examiner*—Erick Solis
*Attorney, Agent, or Firm*—Ernest A. Beutler

[57] ABSTRACT

A fuel injection delivery system for a V type engine having fuel injection nozzles for each cylinder bank and fuel rails for each bank of cylinders. Each fuel rail has a delivery path for supplying fuel under pressure to the injection nozzles and a return path for returning excess fuel to the fuel tank. The fuel is delivered to the delivery paths at one end of the fuel rails and is returned from the return paths at one end of the fuel rails. Series and parallel flow arrangements are disclosed.

4 Claims, 8 Drawing Sheets

FUEL DELIVERY SYSTEM FOR V-TYPE ENGINE

This is a continuation of application Ser. No. 500,364, filed Mar. 28, 1990, now abandoned.

BACKGROUND OF THE INVENTION

This invention relates to a fuel delivery system for a V type engine and more particularly to an improved fuel delivery system for the injection system of an engine having its cylinders arranged in banks.

V type engines are very popular for a variety of reasons. Because of their configuration, it is possible to make the engine more compact than in line type of engines. However, there are some difficulties with the design of the components for a V type engine. For example, it is desirable to employ a fuel injection system for the engine and particularly one in which the injectors discharge either directly into the cylinders or into the intake ports thereof. This means that there will be a row of injectors for each cylinder bank. With the prior art constructions it has been difficult to insure that the fuel pressure does not vary from cylinder to cylinder and/or from bank to bank.

This may be best understood by reference to FIG. 1 which is a schematic view showing the injection system of a V-8 type of engine having a typical prior art construction. As may be seen, the engine is comprised of a first bank of cylinders that has associated with it injection nozzles 21 and a second bank of cylinders which has associated with it a row of injection nozzles 22. In accordance with the typical practice, a remotely positioned fuel tank 23 delivers fuel through a conduit 24 first to a fuel rail 25 associated with the injector nozzles 21. A pressure pump 26 is provided in the line 24 for delivering this fuel. Fuel then flows from the fuel rail 25 to a fuel rail 27 that is associated with the injector nozzles 22 through an interconnecting conduit 28. Excess fuel is then returned to the fuel tank 23 through a return line 29.

It should be readily apparent that there is a long flow path between the respective injector nozzles 21 and 22 and the injector nozzle 21 closest to the line 24 is very likely to receive fuel under a higher pressure than the injector nozzle 22 adjacent the line 29. In addition, there can be cylinder to cylinder variations and specifically variations between the nozzles 21 associated with the rail 25 and the nozzles 22 associated with the rail 27. As a result, it is difficult to provide good and uniform engine running, and maximum power.

It is, therefore, a principal object of this invention to provide an improved fuel delivery system for the injection system of a V type engine wherein all cylinders will receive the fuel at the same pressure.

It is a further object of this invention to provide an injection system for a V type engine wherein the likelihood of cylinder to cylinder and bank to bank pressure variations is substantially eliminated.

It is a further object of this invention to provide an improved and simplified fuel delivery system for a V type engine.

SUMMARY OF THE INVENTION

This invention is adapted to be embodied in a fuel supply system for an internal combustion engine having a pair of cylinder banks. Fuel injectors are provided for supplying fuel to the cylinders of the respective banks. A pair of fuel rails are associated with a respective one of the cylinder banks for supplying fuel to the respective injectors thereof. In accordance with the invention, each of the fuel rails has a delivery path and a return path. Conduit means delivery fuel from the fuel tank to each of the fuel rail deliver paths at one end thereof and return conduit means return fuel to the fuel tank from the return path of each of the fuel rails at one end thereof.

DETAILED DESCRIPTION OF THE PREFERRED EMBODIMENTS OF THE INVENTION

Figure 1:
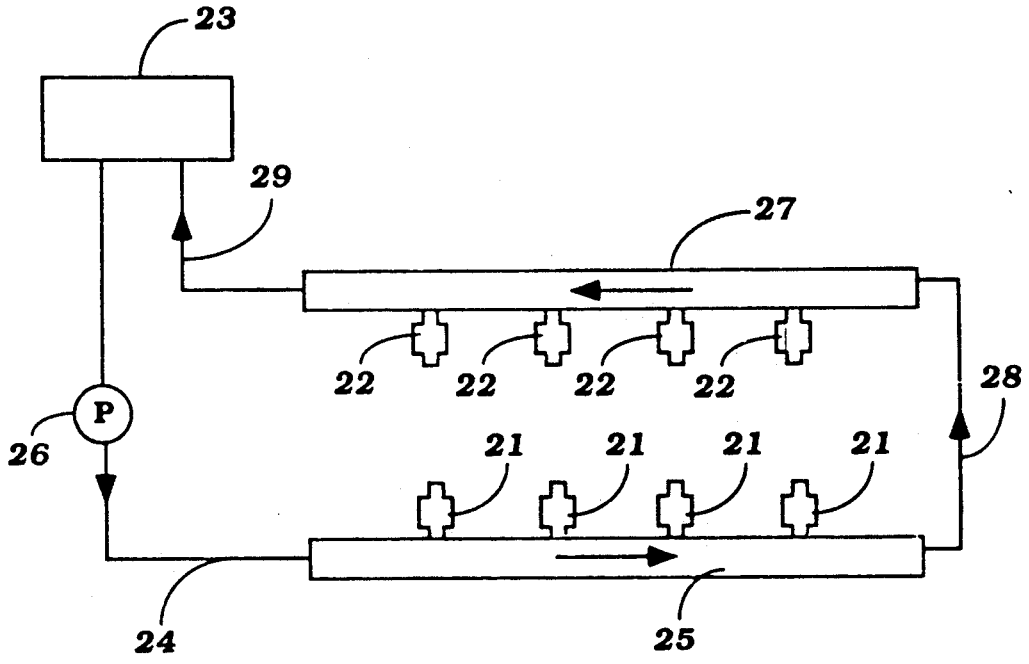
Figure 1 Prior Art
FIG. 1 is a schematic view of a prior art type of fuel delivery system for a V type engine.
Figure 2:
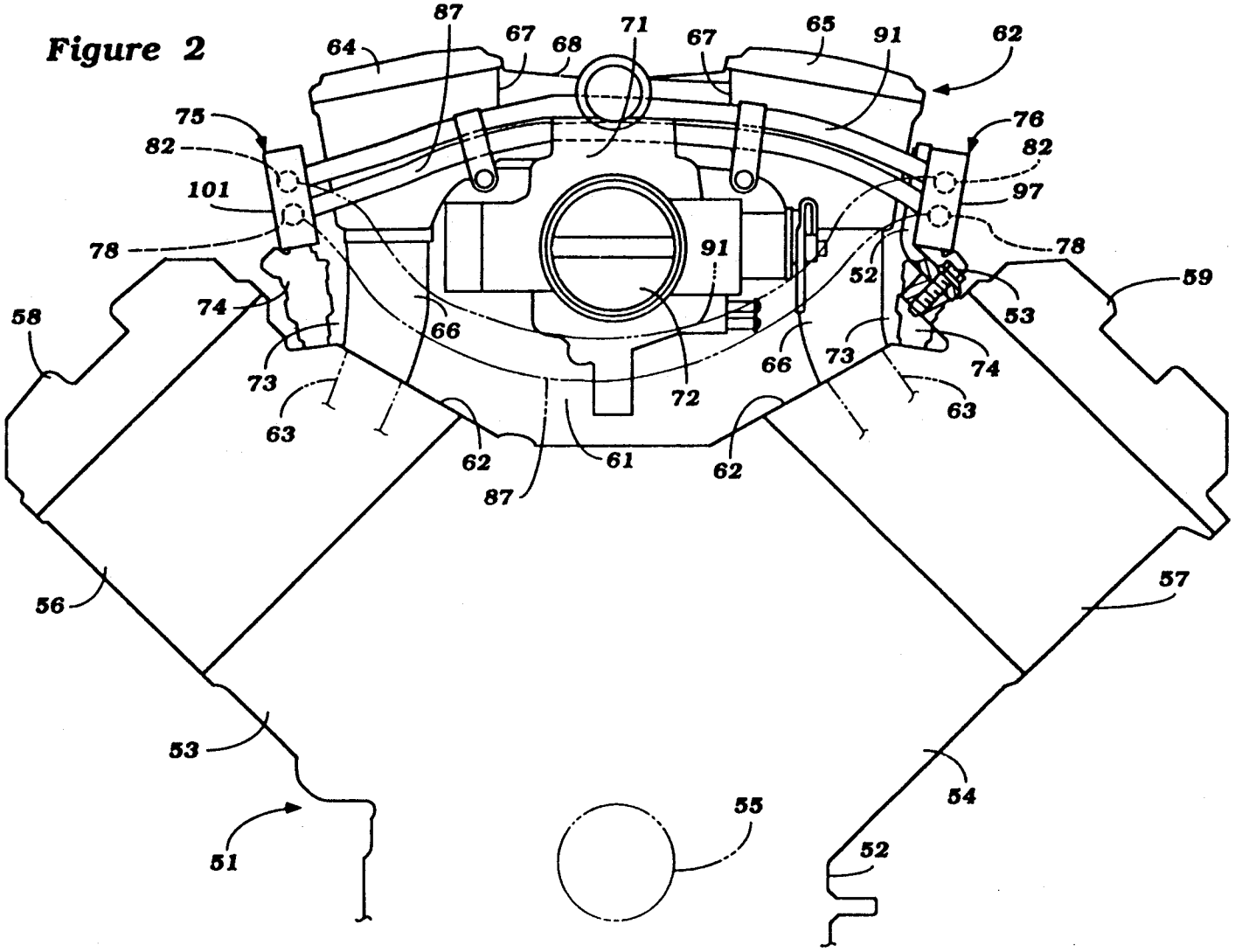
FIG. 2 is a partial front elevational view of a V type engine having a fuel delivery system constructed in accordance with a first embodiment of the invention.
Figure 3:
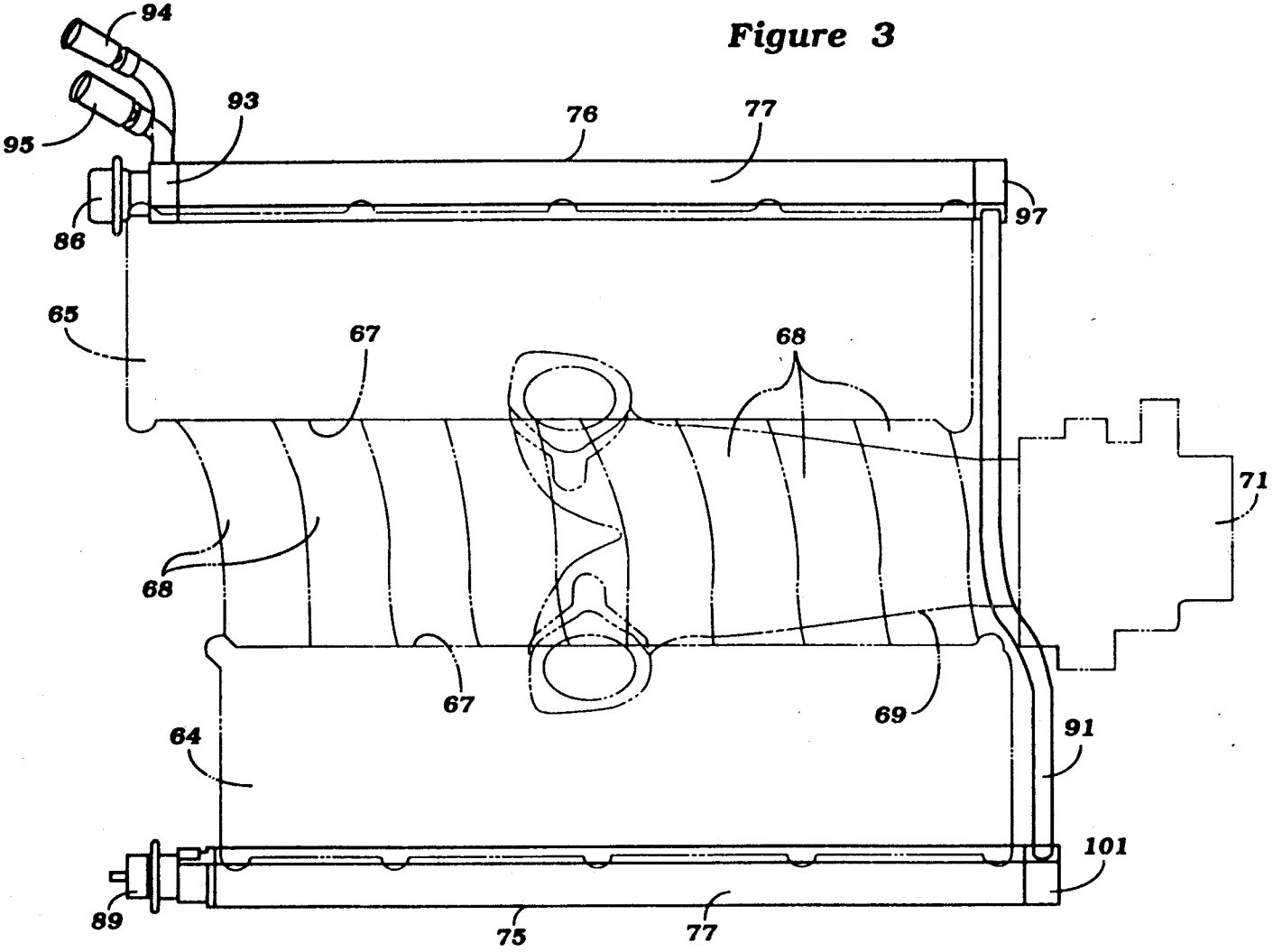
FIG. 3 is a top plan view of the engine with the fuel delivery system shown in solid lines and the induction system shown in phantom.

Referring first to FIG. 2, a V-8 type engine constructed in accordance with this embodiment of the invention is shown partially and is identified generally by the reference numeral 51. Although the invention is described with a V type engine having eight cylinders, it is to be understood that the invention can be employed with engines having other numbers of cylinders and with any varying V angle between the cylinder banks.

The engine 51 includes a cylinder block 52 having a left hand cylinder bank 53 and a right hand cylinder bank 54. Since the invention deals with the injection system and fuel delivery system therefor, the internal components of the engine have not been illustrated.

A crankshaft 55 is journaled for rotation within the cylinder block 52 and is connected to pistons, as is well known in this art. A left hand cylinder head assembly 56 is affixed to the cylinder bank 53 and a right hand cylinder head assembly 57 is affixed to the cylinder bank 54 in a known manner. Cam covers 58 and 59 are affixed to the respective cylinder heads 56 and 57 and enclose the valve train and valve actuating mechanism, which may be of any known type.

The cylinder banks 53 and 54 and cylinder heads 56 and 57 define a valley 61 therebetween in which an induction system, indicated generally by the reference numeral 62 is positioned. The induction system may be of a type as disclosed in the copending application entitled "Intake System For V Type Engine", Ser. No. 481,975, filed Feb. 16, 1990 and assigned to the assignee of this application. Reference may be had to that application for the description of the induction system. Of course, other induction systems may be employed in conjunction with the invention, but the induction system in the aforedescribed copending application is particularly compact and it lends itself to the positioning of the fuel induction system and its fuel delivery system as will be described herein.

Basically, each of the cylinder heads 56 and 57 have facing surfaces 62 which define the valley 61 and through which intake passages 63 of the respective cylinder heads extend. A pair of plenum chambers 64 and 65 lie over each of the cylinder banks and supply air to them through inlet pipes 66. The plenum chambers 64 and 65 have facing surfaces 67 across which manifold runners 68 extend as described in the aforenoted patent application. A manifold inlet section 69 extends beneath the valley of the V of the engine and supplies air from a throttle body 71 to the respective plenum chamber 64 and 65. A throttle valve 72 is positioned in the throttle body 71 for controlling the engine speed in a well known manner. As aforenoted, the induction system as thus far described is only typical of one in which the invention may be employed. For that reason, a further description of it is believed to be unnecessary.

It should be noted that the manifold inlet sections 66, however, are spaced from the cylinder head and thus define gaps 73 between the runners and the cylinder head. This feature of the induction system is important because it permits injection nozzles 74 to be mounted in each of the cylinder heads 56 and 57 on their inlet side. The injector nozzles 74 may be of any known type and specifically are of the electrically actuated type, and discharge fuel into the intake ports 63 of the respective cylinder heads in a well known manner.

Left and right fuel rails, indicated generally by the reference numerals 75 and 76 are associated with each of the cylinder banks 56 and 57, respectively, for supplying fuel to the injection nozzles 74 and returning fuel to the fuel tank, as will be described. The fuel rails 75 and 76 are, in the illustrated embodiment, formed from extrusions or castings and have a generally rectangular cross sectional configuration. The construction of the fuel rails 75 and 76 may be best understood by reference to FIGS. 4 through 6.

Figure 6:
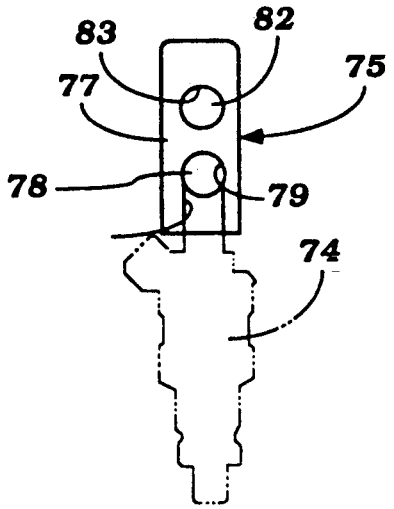
FIG. 6 is a cross sectional view showing one of the fuel rails and its association with one of the injector nozzles.
Figure 7:
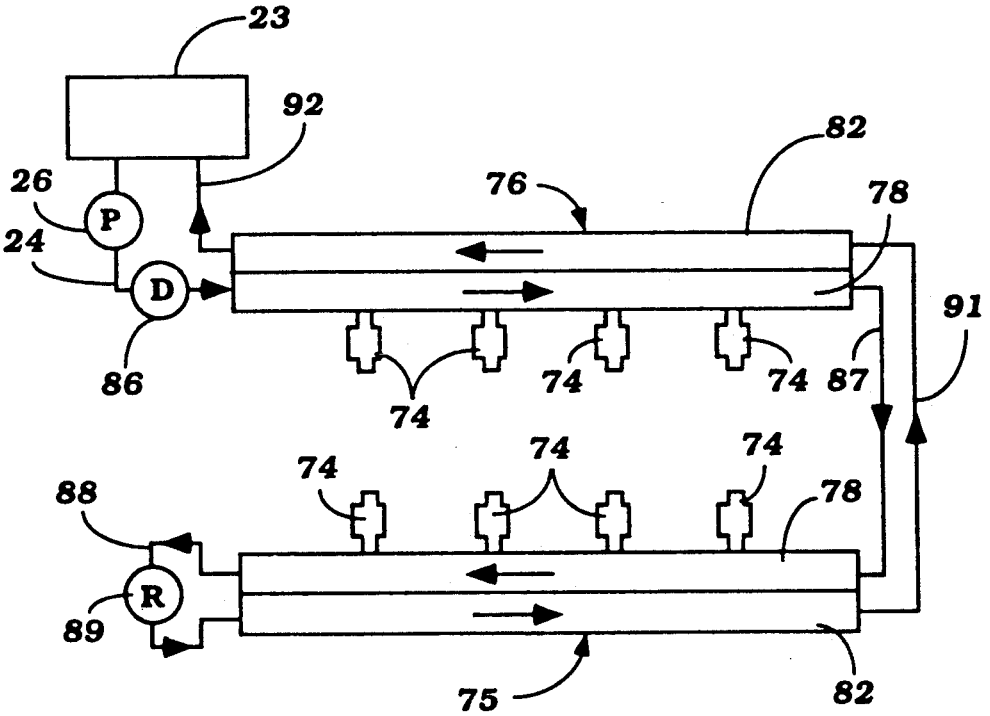
FIG. 7 is a schematic view, in part similar to FIG. 1, and shows the fuel delivery system in accordance with this embodiment of the invention.
Figure 8:
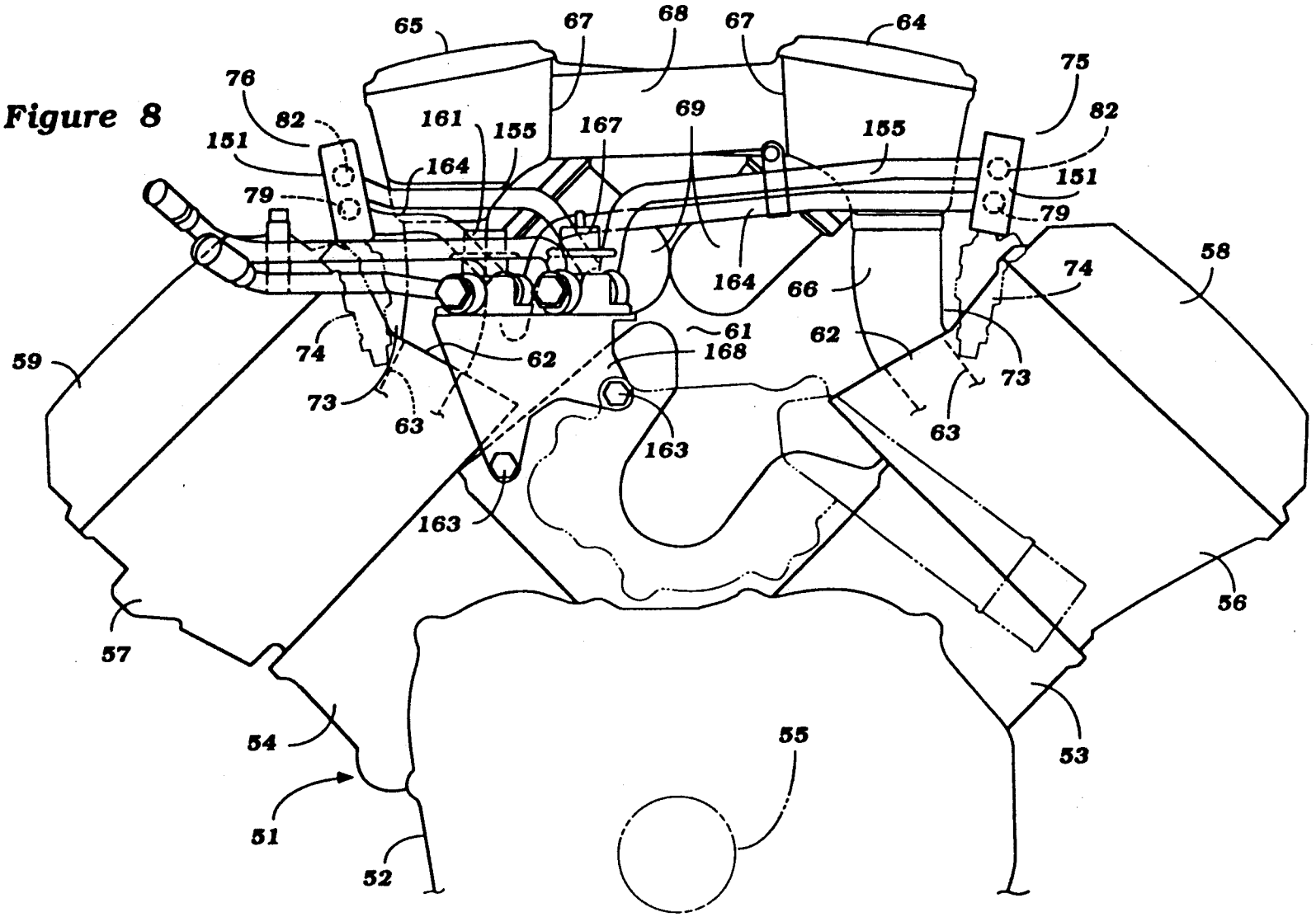
FIG. 8 is a partial front elevational view of a V type engine having a fuel delivery system constructed in accordance with another embodiment of the invention

Each fuel rail 75 and 76 has generally the same central configuration and, for that reason, the central portions will be identified by the same reference numerals as will the parts thereof. These central portions 77 are each formed with a fuel delivery path 78, which is disposed adjacent the injection nozzle 74 and which is defined by a through bore 79. The path 78 is intersected along its length by passages 81 that are designed so as to accept a portion of the injector nozzles 74 as best shown in FIG. 6 so as to permit pressurized fuel to be delivered thereto. There is further provided a return fuel path 82 which is formed by a through bore 83 in the central portions 77 for returning the fuel to the fuel tank in a manner to be described Furthermore, the central body portion 77 is provided with a pair of mounting bosses 84 so as to permit attachment to the cylinder heads 56 and 57.

In accordance with the invention, the fuel rails 75 and 76 and specifically their central portions 77 are provided with end caps and a communicating conduitry so that fuel is delivered into the pressure paths 78 thereof at one end of the respective fuel rails 75 and 76 and so that fuel is discharged therefrom back to the fuel tank from the return paths 82 at one end thereof. A specific arrangement in which this is accomplished is shown schematically in FIG. 6.

As will become apparent, fuel is delivered from the fuel tank 23 under the pressure of a fuel pump 26 through a conduit 24 to one end, the front end or non intake end of the fuel rail 76 through a pressure damper 86. The pressure damper 86 acts like an accumulator so as to dampen pulsations in vibration in the fuel. This fuel then flows through the delivery path 78 of the fuel rail 76 toward the induction system inlet. A cross over conduit 87, which passes either above the intake device 71 as shown in FIG. 2 or below it as shown in the phantom lines of this figure, interconnects the inlet side of the pressure path 78 of the fuel rail 75 with the intake end of the pressure path 78 of the fuel rail 75. Fuel then flows axially along the pressure path 78 to a cross over passage 88 formed at the front end of the fuel rail 75 in which a pressure regulator 89 is positioned. The pressure regulator 89 serves to maintain a constant pressure in the fuel conduit and specifically the pressure paths 78 of the fuel rails 76 and 75.

The fluid discharged from the pressure relief is then passed through the return path 82 of the fuel rail 75 toward its inlet end. A conduit 91 interconnects this end of the fuel rail 75 with the inlet end of the fuel rail 76 and specifically its return path 82. Fuel then flows axially along this return path and is returned to the fuel tank through a return conduit 92. As a result, uniform pressure will be maintained in the pressure paths 78 of both of the fuel rails 75 and 76. There will be no significant pressure drop therealong.

Figure 4:
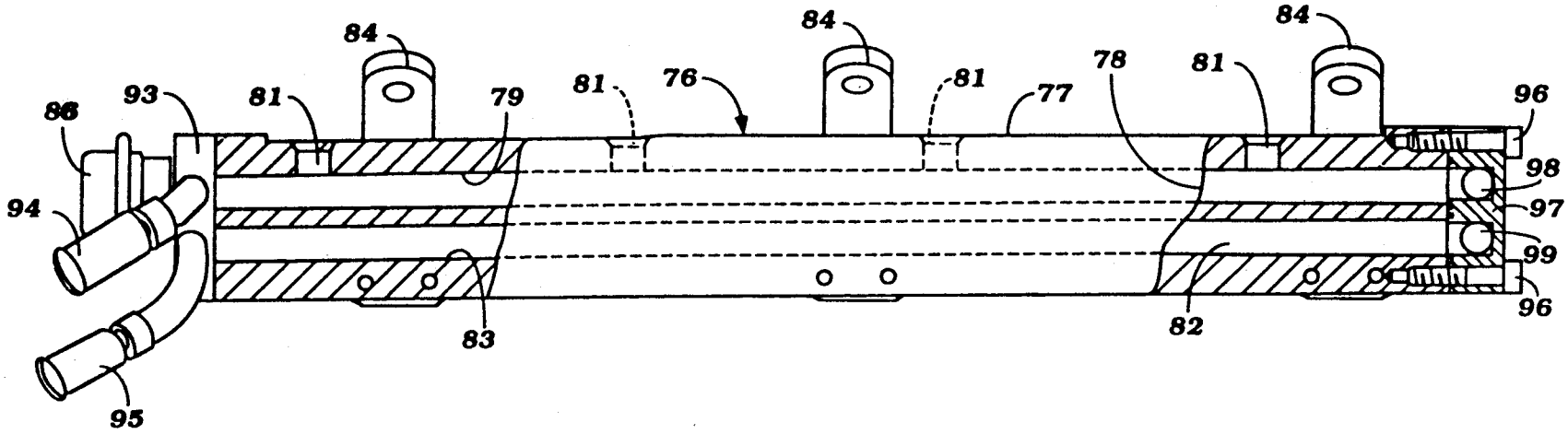
FIG. 4 is a top plan view, with a portion broken away, of the fuel rail associated with one of the cylinder banks.
Figure 5:
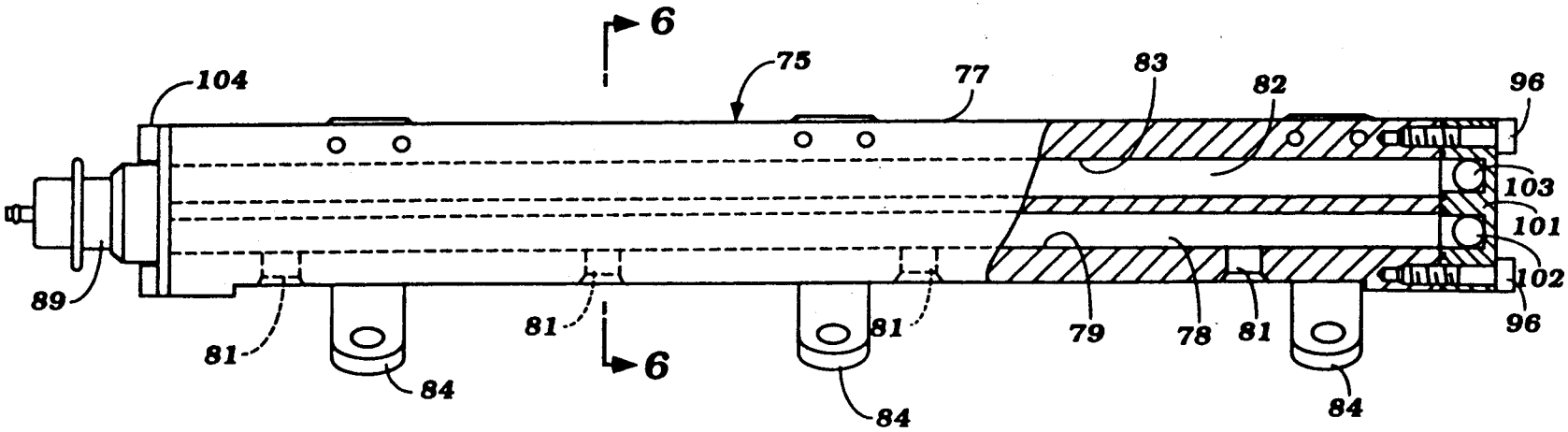
FIG. 5 is a top plan view, with a portion broken away, of the fuel rail associated with the other of the cylinder banks.

As may be seen in FIG. 4, the fuel rail 76 has a first header or end cap 93 having fittings 94 and 95 which communicate with the conduits 24 and 92, respectively. The pressure damper 86 is, as shown in this figure, mounted on the end cap 93. The end cap 93 is affixed to the main body portion 77 in a suitable manner as by screws such as the screws 96 which secure a corresponding end cap 97 to the opposite or intake end of the main body portion 77. The end cap 97 has conduits 98 and 99 which are connected to the conduits 87 and 91 respectively. A similar end cap 101 is affixed to the main body portion 77 of the fuel rail 75 also by screws 96. This end cap has conduits 102 and 103 that communicate respectively with the conduits 87 and 91.

The opposite or front end of the fuel rail 75 is closed by a further end cap 104 in which the pressure regulator 105 is positioned. As a result, it should be readily apparent that a very simple and yet effective arrangement is provided for insuring that the injector nozzles 74 will all receive fuel at the appropriate pressure and that these pressures will be uniform.

As has been noted, the advantage of the construction is the use of the pressure and return paths in each fuel rail. FIGS. 2 through 7 are typical of one variation in which the conduitry can be employed. FIGS. 8 through 11 show another embodiment wherein both the inlet and returns are all at the same end of each of the fuel rails. Because of the similarity of this embodiment to the previously described embodiment, components which are the same have been identified by the same reference numerals and will be described again only insofar as is necessary to understand the construction and operation of this embodiment.

In this embodiment, the inlet and outlet conduits connected to the pressure and return paths are all disposed at the front or non inlet end of the engine. For this reason, each front of the rails 75 and 76 is closed by an identical closure plug 151 by means of screws 152. Each closure plug 151 has a pressure conduit 153 and a return conduit 154 which are connected in a manner to be described.

The opposite ends of the main body portion 77 are closed by means of a pair of cylindrical plugs 155 that are pressed in place with a cross passage 156 being formed between the pressure and return paths 78 and 82 at this end. Alternatively, a closure plug may be utilized at the inlet end that has such a cross passage in it.

Figure 9:
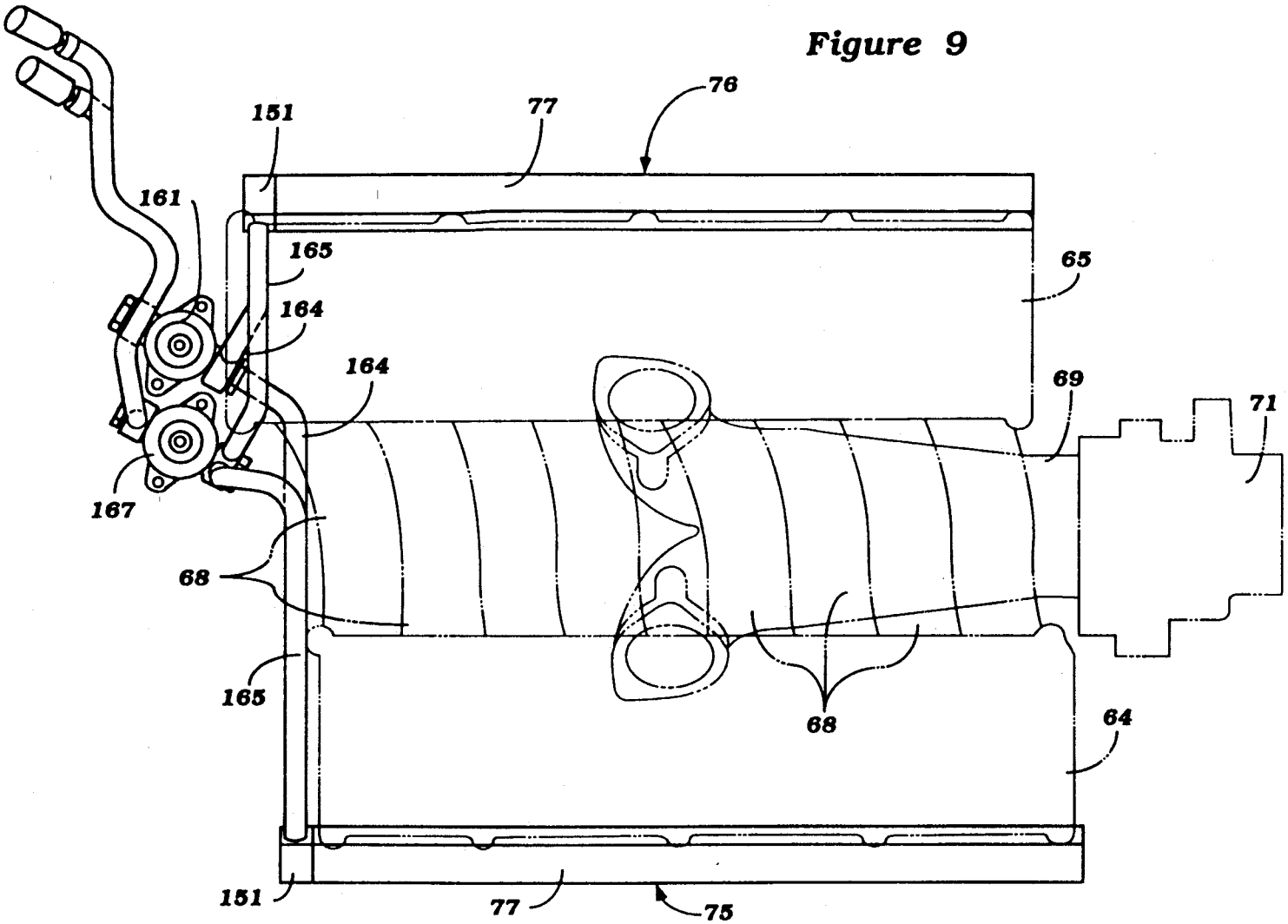
FIG. 9 is a top plan view of this embodiment showing the fuel delivery system in solid lines and the induction system in phantom.
Figure 10:
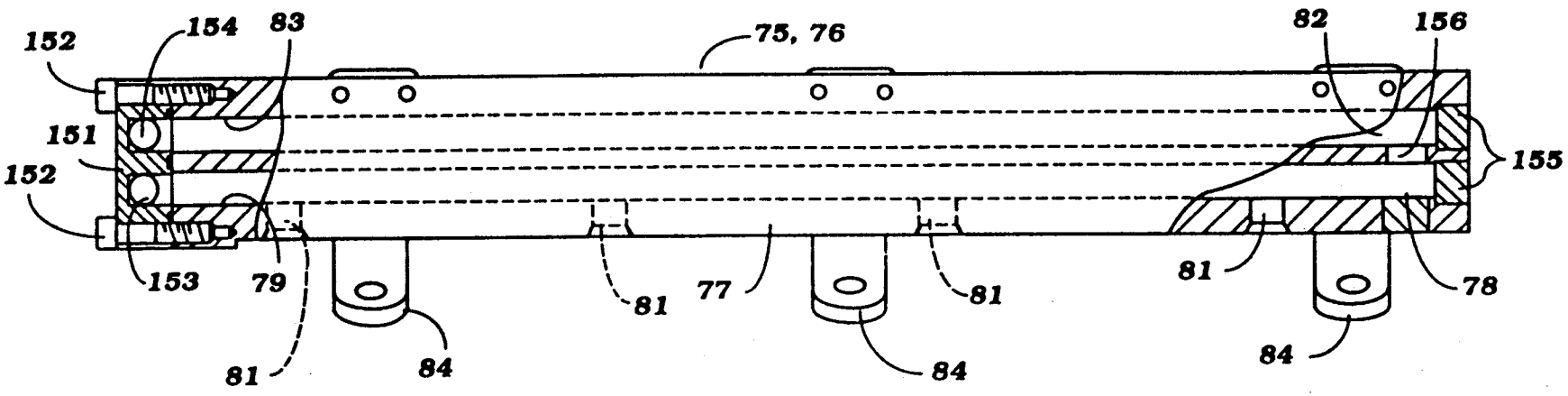
FIG. 10 is a typical side elevational view of the fuel rails constructed in accordance with this embodiment of the invention, with portions broken away.
Figure 11:
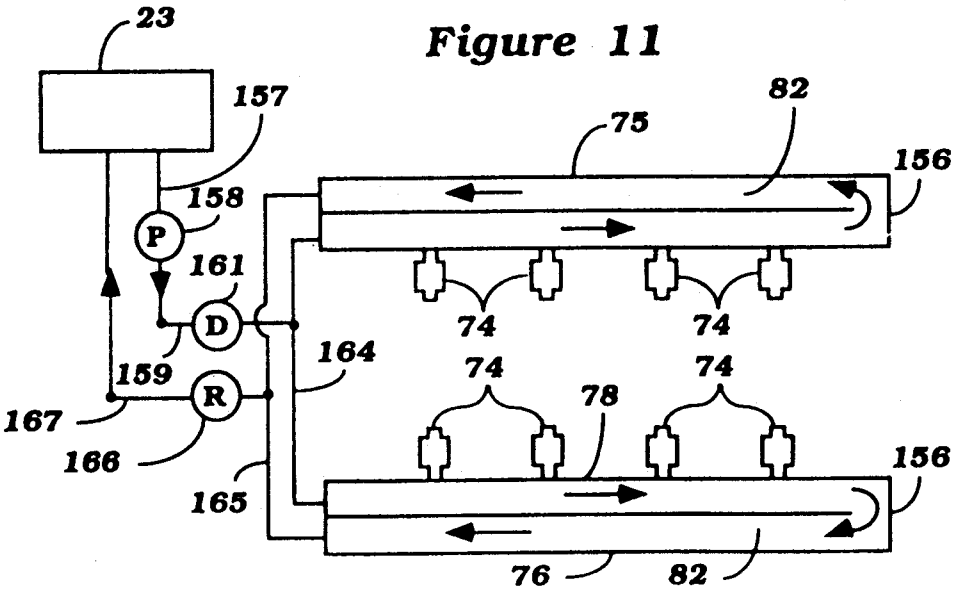
FIG. 11 is a schematic view showing the fuel delivery system of the embodiment of FIGS. 8 through 11.

Referring now specifically to FIGS. 9 and 10, the fuel tank 23 has connected to it a conduit 157 in which a pressure pump 158 is positioned. The pressure pump 158, in turn, discharges through a conduit 159 to a pressure damper 161 which may conveniently be mounted on a mounting bracket 162 (FIG. 8) that is fixed to the front side of the engine by fasteners 163. A pair of conduits 164 are connected to the conduits 153 of the end caps 151 so that there is a parallel flow path to the inlet paths 78 of the fuel rails 75 and 76 rather than a series flow path as in the previously described embodiment.

In a similar manner, a pair of return conduits 165 are connected in communication with the conduits 154 of the headers 151 and convey the return fluid to a pressure regulator 166 which, in turn, bypasses the fuel back to the tank 23 through a return conduit 167 so as to maintain the desired maximum pressure in the system.

It should be readily apparent that various other flow paths may be provided with the basic construction as thus far described. Various other changes and modifications may be made without departing from the spirit and scope of the invention, as defined by the appended claims.

I claim:

1. A fuel supply system for an internal combustion engine having a pair of angularly related cylinder banks, a pair of cylinder heads each affixed to a respective one of said cylinder banks, an air manifold for drawing atmospheric air and delivery to each of said cylinder heads through respective inlet pipes, a pair of sets of fuel injectors for supplying fuel to the cylinder heads of the respective cylinder banks on the outer sides of the respective inlet pipes, and a pair of fuel rails, each associated with a respective one of said cylinder heads and disposed outwardly of said air manifold for supplying fuel to the respective cylinders thereof, each of said rails having an opening to receive and supply fuel to the respective fuel injectors of the respective cylinder banks said fuel injectors being mounted on said cylinder heads, the improvement comprising each of said fuel rails having delivery path and a return path positioned vertically above each other and aligned above said openings, delivery conduit means for delivering fuel from a fuel tank in parallel paths to each of said fuel rail delivery paths at one end thereof, return conduit means for returning fuel in parallel paths from the return paths of said fuel rails at said one end thereof to a common conduit, a pressure regulator valve in said common conduit for regulating the pressure in each of said fuel rails, and a relief conduit leading from said pressure regulator to said fuel tank.

2. A fuel supply system as set forth in the claim 1 wherein the delivery conduit means and the return conduit means are disposed at the same end of the induction system.

3. A fuel supply system as set forth in claim 2 wherein the pressure regulator valve is disposed at least in part forwardly of the induction system and between the outer extremities thereof.

4. A fuel supply system as set forth in claim 1 wherein each fuel rail includes a tubular member having a dividing baffle extending there along to define within the tubular member the delivery and return paths and further including closure means at one end of said tubular member providing the communication of the delivery conduit means with the respective fuel rail and of the return conduit means with the respective fuel rail.

* * * * *